US006052655A

United States Patent [19]

Kobayashi et al.

[11] Patent Number: 6,052,655

[45] Date of Patent: Apr. 18, 2000

[54] SYSTEM FOR CONVERTING INPUT/OUTPUT SIGNALS WHERE EACH AMPLIFIER SECTION COMPRISES A STORAGE UNIT CONTAINING INFORMATION ITEMS RELATING TO AN ASSOCIATED TERMINAL END

[75] Inventors: Teruo Kobayashi, Hitachinaka; Kouji Oono, Tsuchiura; Masahiro Fujita; Shigemi Kitakami, both of Ibaraki-ken; Shinzou Noguchi, Mito; Ryoichi Nagase, Hitachinaka, all of Japan

[73] Assignee: Hitachi, Ltd., Tokyo, Japan

[21] Appl. No.: 09/040,104

[22] Filed: Mar. 17, 1998

[30] Foreign Application Priority Data

Mar. 19, 1997 [JP] Japan ..... 9-066054

[51] Int. Cl.[7] ..... G06F 5/01

[52] U.S. Cl. ..... 702/184; 702/57; 702/85; 702/86; 702/104; 702/127; 710/15; 710/18; 710/129; 710/130

[58] Field of Search ..... 47/17; 340/517, 340/870.17; 364/184; 702/51, 183, 57, 85, 86, 104, 127, 189; 710/15, 18, 124, 130

[56] References Cited

U.S. PATENT DOCUMENTS

| | | | |
|---|---|---|---|
| 4,430,828 | 2/1984 | Oglevee et al. | 47/17 |
| 4,725,819 | 2/1988 | Sasaki et al. | 340/517 |
| 5,005,142 | 4/1991 | Lipchak et al. | 702/183 |
| 5,057,994 | 10/1991 | Spiller | 364/184 |
| 5,070,732 | 12/1991 | Duncan et al. | 73/431 |
| 5,253,185 | 10/1993 | Mutchler et al. | 702/183 |
| 5,319,572 | 6/1994 | Wilhelm et al. | 702/51 |
| 5,703,575 | 12/1997 | Kirkpatrick | 340/870.17 |

FOREIGN PATENT DOCUMENTS

| | | |
|---|---|---|
| 34 33 760 | 6/1986 | Germany . |
| 35 42 162 | 5/1987 | Germany . |

*Primary Examiner*—Thomas C. Lee
*Assistant Examiner*—Chien Yuan
*Attorney, Agent, or Firm*—Kenyon & Kenyon

[57] ABSTRACT

A signal converter which receives signals from a plurality of sensor terminal ends to detect physical quantities in a plant and conducts a necessary correction for the signals to send the signals to a host computer or which transmits signals from the host computer to operation terminal ends in the plant includes a sensor terminal end amplifier including a processing unit for receiving a signal from a sensor terminal end and conducting a predetermined amplifying operation for the signal and a storage unit in which information items related to the sensor terminal and the processing unit are stored, an operation terminal end amplifier including a converting unit for converting signals into predetermined control signals which can be received by the operation terminal end and a storage unit in which information items related to the operation terminal end and the converting unit are stored, and a signal converting section including a connecting unit for connecting the sensor terminal amplifier section to the operation terminal amplifier section and a signal processing unit for conducting signal processing to communicate with the host computer.

4 Claims, 7 Drawing Sheets

SYSTEM FOR CONVERTING INPUT/OUTPUT SIGNALS WHERE EACH AMPLIFIER SECTION COMPRISES A STORAGE UNIT CONTAINING INFORMATION ITEMS RELATING TO AN ASSOCIATED TERMINAL END

BACKGROUND OF THE INVENTION

The present invention relates to a signal converter and a process control signal output circuit in which signals received from various types of sensors are converted into electric signals for easy handling thereof, and in particular, to a signal converter for the process signal measurement especially in a case in which a signal converter suitable for a multi-point input operation of a temperature converter employing a thermoresistance and a thermocouple is to be universalized for a multi-range operation and in which process control signal output modules are installed at a large number of points for the process control operation.

In procedures involving process control operation, various kinds of sensors such as transmitters and converters to measure pressure and/or differential pressure and thermocouples and thermoresistances to sense temperature are installed in a plant such that measured values from the sensors are received by a host computer to monitor the state of the plant to thereby control the operation of the plant in accordance with the measured values. The values sent from the sensors cannot be directly processed by the host computer. Signals representing the measured values from the sensor are required to be transformed into, for example, specified signals ranging from one (1) dc volt to 5 dc volts. A signal converted is ordinarily disposed between the sensors and the host computer for the signal matching operation therebetween.

Additionally, although the converter handles input signals from the sensors to the host computer, when the host computer transmits to terminals, e.g., valves control signals resultant from process control operations for values of proportion, integration, and differentiation (PID), namely, when the computer processes control output signals ranging from 4 dc milliampere (mA) to 20 dc mA or from 1 dc V to 5 dc V, there is usually installed a multi-point control output unit in addition to the signal converter in the plant.

Description will be given of a conventional example of system constitution by referring to a simple plant configuration shown in FIG. 5. The example includes two loops each accomplishing a simple process to control operation of a boiler in which fuel is fed to the boiler to regulate its steam temperature.

FIG. 5 includes a host computer 201 to conduct control arithmetic operations such as PID calculations, a process input/output (PIO) unit 502 which conducts an analog-to-digital (A/D) conversion to transform analog signals from a converter unit into digital signals to thereby serve as a communication interface for the host computer 201, an analog input board 503, an analog output board 504, a communication interface 505, a power supply 506, and a communication cable 507. Moreover, there are included a signal converter unit 508 to convert signals from sensors, signal converter modules 509 to 512, an interface 513 to receive analog signals from plural converter modules to connect the signals to the input board 503, a power supply 514, and a signal cable 515. FIG. 5 further includes a terminal strip unit 516 to couple an output signal from the output board 504 with a processing unit, terminal strips 517 and 518, and interface 519 for signal transmission. The unit 516 is linked with a plurality of terminal strips for, ordinarily, 8, 16, or 32 points. The strip includes an external connection terminal which connects a control valve or the like and which conforms to M4 screw specifications in ordinary cases. The terminal is independently disposed, not mounted on the PIO unit 502. The system further includes a flow (rate) meter 221, a control valve 222, a temperature sensor terminal 223, and a boiler 224. Operation of the configuration will now be described.

First, signals from the flow meters 221-1 221-2 and the temperature sensor terminal ends 223-1 and 223-2 are fed respectively to the converter modules 509 to 512 of the unit 508 for conversion thereof. The unit 508 is linked with a plurality of terminal strips for 8, 16, or 32 points. Signals from the respective modules are fed to the interface 513 to be supplied via the cable 515 to the input board 503 of the unit 502. The input board 503 converts an analog input signal from the converter unit 508 into a digital value. The process signal representing the digital value is transmitted via the interface 505 to the host computer 201.

Receiving the process signal, the computer 201 executes an arithmetic operation such as the PID operation to thereby attain a control output value. The value is then inputted via the cable 507 and the interface 505 to the analog output board 504. The board 504 transforms a plurality of digital values into analog signals to produce control output values corresponding to outputs of first-loop and second-loop operations. These output values are supplied via the cable 520 and the interface 519 to the terminal board unit 516 to be fed therefrom via the terminal boards 517 and 518 to the control valves 222-1 and 222-2, respectively.

Each process of the first and second loops is a simple example in which fuel is supplied to the boiler to control the steam temperature thereof. As above, there is constructed a control loop in which the steam temperature and the flow rate of fuel are measured and the PID operation is conducted for the measured values to supply control output signals to the valves.

Next, description will be given in detail of the converter modules 509 to 512 of the unit 508 in the system.

Various types of sensors are connected to the sensing terminal points and obtained signals vary within various ranges. In the converter module, consequently, the gain and bias values of an amplifier circuit thereof are required to be set and adjusted for each sensor. If electric insulation is required, it is necessary to provide an insulating circuit.

Description will now be given of the conventional converter modules utilizing a thermocouple as its sensor (specifically, a K-type thermocouple with an operating temperature ranging from 300° C. to 600° C.).

The first converter module will now be described. FIG. 3 shows constitution of the module.

FIG. 3 includes an input terminal 1, an initial-stage amplifier 2, a gain setting resistor 3 to set the gain of the amplifier 2, a bias power supply 4, a bias setting circuit 5, an insulating circuit 6, an output circuit 7, and an output terminal 8.

First, the thermocouple signals corresponding to temperature values ranging from 300° C. to 600° C. are transformed into voltage signals ranging from 1 dc V to 5 dc V to be inputted to the PIO unit 502. In the conversion, values of thermoelectromotive force of the thermocouple ranging from 12.207 mV to 24.902 mV are multiplied by about 315 to obtain voltages ranging from 3.846 V to 7.846 V. Adding thereto a bias value of −2.846 V, there are obtained voltage values ranging from 1 dc V to 5 dc V. Consequently, when the K-type thermocouple with the operating temperature ranging from 300° C. to 600° C. is adopted as the sensor, it is required to set the default values beforehand, i.e., 315 as the gain setting value and −2.846 V as the bias value. The first converter module is therefore initialized as follows. The gain setting resistor 3 is first appropriately adjusted, the gain value of the amplifier 2 is set to 315, and then the bias power supply 4 and the bias setting circuit 5 are adjusted to set the bias value to −2.846 V.

As above, in the configuration example of the first converter module, the gain and bias values are calculated beforehand in accordance with the type of the sensor and the range of input signal values to thereby set and adjust the circuit constants.

Referring next to FIG. 4, description will be given of a configuration example of the second converter module including a microcomputer.

In FIG. 4, the same components as those of FIG. 3 are designated by the same reference numerals. The configuration includes an input terminal 1, an initial-stage amplifier 2, an output circuit 7, an output terminal 8, an analog-to-digital (A/D) converter 9, a digital signal processing circuit 10 including a microcomputer, an insulating circuit 11, and a digital-to-analog (D/A) converter 12.

In this example, the sensor type and the signal range can be set by the processing circuit 10. While the gain setting resistor and the bias power supply are set to select only the necessary signal range for each sensor type in the first converter module, the measuring ranges of particular sensors such as thermocouples and thermoresistances are set to their full-span values to select only the necessary signal ranges through arithmetic operations by the circuit 10. For example, in the measuring ranges of the thermocouples, the thermoelectromotive force takes values of from −10 mV to 80 mV. In accordance with the input values in this range, an signals which can be inputted to the second converter module. For example, when it is assumed that the input signal is multiplied by 89 in the amplifier 2 and a bias voltage of 1.9 V is added to the amplified value, signals ranging from −10 mV to 80 mV are converted into signals ranging from 1 V to 9 V. Assume that the A/D converter has an input range of from 0 V to 10 V and that a range of from 0 V to 1 V and a range of from 9 V to 10 V constitute an underflow zone and an overflow zone, respectively. With this provision, the module can cope with any kinds of thermocouples including K-type and E-type thermocouples such that the other necessary setting operations are achieved through arithmetic operations.

The processing circuit 10 includes an area to store therein the sensor types and signal ranges; moreover, there are disposed data tables for linearization for a plurality of sensors. As correction data, for example, for thermocouples, values of thermoelectrodynamic force are defined in the Japanese Industrial Standard (JIS). When these values are set beforehand to a data table of correction data, interpolation can be easily conducted in the linearization with the data.

In this configuration, as in the first converter module, when a K-type thermocouple with an operation range of from 300° C. to 600° C. is assumed to be connected to the input terminal, the thermocouple type and the signal range are respectively set in advance to "K type" and "from 300° C. to 600° C." in the processing circuit 10. It is defined in the circuit 10 that the input zero point is set to 12.207 mV and an output of 1 dc V corresponds to 300° C.; moreover, the input span point is at 24.902 mV and an output of 5 dc V corresponds to 600° C. The control operation with respect to ranges and the output processing are achieved under this condition. In the data table, a portion thereof related to the range of from 300° C. to 600° C. is selected for the correction.

The second converter module constructed as above can produce desired output signals only by inputting thereto sensor types and signal ranges. Namely, the module is not required to calculate the circuit constants to set the constants therein in accordance with the sensor types and signal ranges.

The first and second converter modules described as examples of the prior art have the following aspects.

Each time a sensor type and a signal range are altered in the first converter module, the gain and bias values are required to be calculated for the setting and adjusting of the circuit constants.

However, a large number of converter modules are employed in the field of process signal measurement. It is therefore a common practice to adopt a block-type converter module like the converter unit 508 of FIG. 5 in which converter modules are classified into groups for 8, 16, or 32 points and which is advantageous in reduction of the installation space and the wiring cost. As a basic element of the multi-point signal converter unit in the configuration above, although the first converter module requires for each point the setting and the adjusting of the gain and bias values at the circuit level, the overall circuit can be constructed at a relatively low cost.

Unlike the first converter module, the setting and the adjusting of the gain and bias values need not be conducted at the circuit level for each alteration of the sensor type and signal range in the second converter modules. Using a high-precision A/D converter and a microcomputer, there can be constructed a converter module which can be appropriately operated only by inputting the sensor types and signal ranges. However, an A/D converter, a microcomputer, and a D/A converter are necessary for each point. When used in a multi-point signal converter facility of the above structure, the second converter module increases the overall cost of the system.

In each of the groups of the first and second converter modules, even when the design values of gain and bias are the same therein, an error of several percent generally takes place due to fluctuation in quality of parts of the respective modules. Conventionally, to correct the error, a variable resistor or the like is arranged for the pertinent module, which has been disadvantageously troublesome.

SUMMARY OF THE INVENTION

It is therefore an object of the present invention to provide a multi-point, block-type signal converter which can be constructed at a low cost and which can be easily adjusted for operation, thereby removing the problems of the first and second signal converters.

Additionally, the PIO unit, the signal converter unit, and the terminal strip unit are separated from each other as shown in the example of the conventional system configuration of FIG. 5. Therefore, when a check is made for each control loop in the system maintenance, the signal converter unit is to be used for the input check and the terminal strip unit is to be operated for the output check. Namely, for each of the input and output signals, the converter module and the terminal strip are required to be respectively identified in the control loop check.

Another object of the present invention is to provide a signal converter in which input and output signals are classified for each control loop to facilitate maintenance thereof.

To achieve the objects above, there is provided a signal converter which receives signals from a plurality of sensor terminal ends, detects physical quantities in a plant, and conducts a necessary correction for the signals to send the signals to a host computer or which transmits signals from the host computer to operation terminal ends in the plant. The signal converter includes a sensor terminal end amplifier section including a processing unit for receiving a signal from the sensor terminal end and conducting a predetermined amplifying operation for the signal and a storage unit in which information items related to the sensor terminal end and the processing unit are stored, an operation terminal end amplifier section including a converting unit for converting signals into predetermined control signals which can be received by the operation terminal end and a storage unit in which information items related to the operation terminal end and the converting unit are stored, and a signal converting section including a connecting unit for connecting the sensor terminal end amplifier section to the operation terminal end amplifier section and a signal processing unit for conducting signal processing to communicate with the host computer.

The most important aspect of the present invention is that each amplifier section is configured in a minimum structure to lower the cost thereof and the signal converting section conducts the linearization and the range operation for a plurality of amplifier sections to thereby reduce the cost of the signal processing section to 1/n (n=8, 16, or 32) of the original cost, and an output amplifier section can be also disposed in the signal converting section. Furthermore, each amplifier section includes storage means to store therein information at detecting terminal ends and adjusting data of amplifier sections such that the amplifier section can be replaced without necessitating the adjusting operation.

BRIEF DESCRIPTION OF THE DRAWINGS

The objects and features of the present invention will become more apparent from the consideration of the following detailed description taken in conjunction with the accompanying drawings in which.

DETAILED DESCRIPTION

Referring now to the accompanying drawings, description will be given of embodiments in accordance with the present invention.

Figure 2:
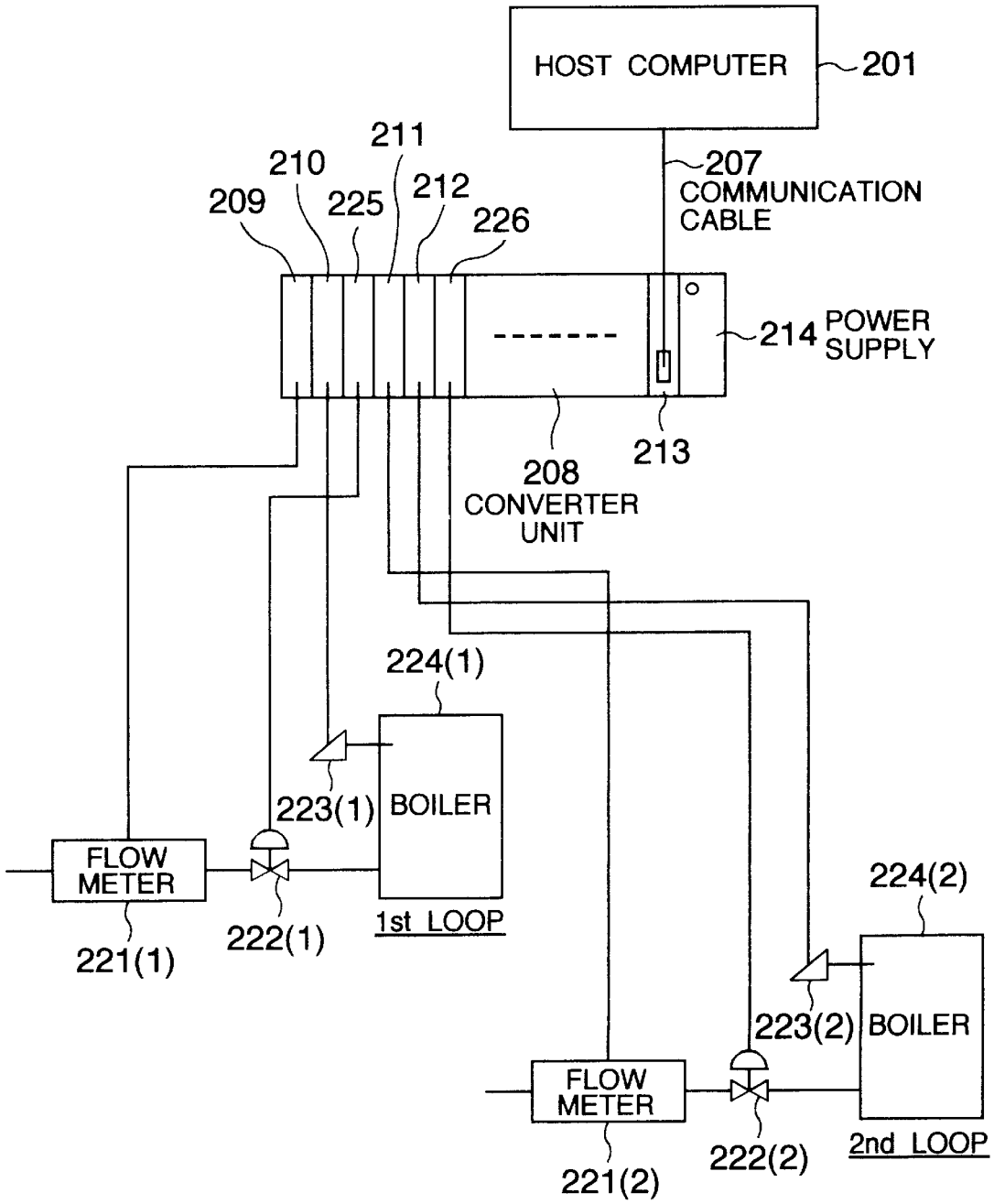
FIG. 2 is a diagram showing a system configuration example using a signal converter in accordance with the present invention.
Figure 3:
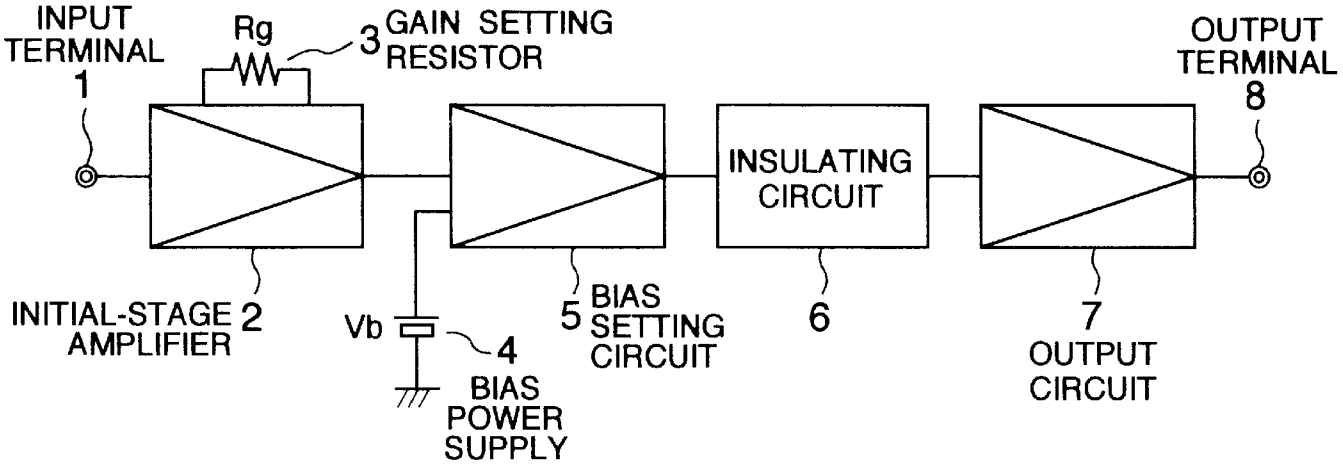
FIG. 3 is a diagram showing a first example of constitution of the conventional signal converter.

FIG. 2 shows a simple example of the process control system employing the present invention.

This configuration includes a host computer 201, a communication cable 207, a converter unit 208, input modules 209 to 212, an interface 213, a power supply 214, a flow rate meter 221, a control valve 222, a temperature sensor terminal end 223, a boiler 224, and output modules 225 and 226. This example includes, like FIG. 5, two loops each carrying out a simple process in which fuel is supplied to the boiler 224 to control the steam temperature thereof.

Description will be briefly given of operation of the configuration in accordance with the present invention. First, signals from the flow meter 221(1) and 221(2) and sensor terminal ends 223(1) and 223(2) are delivered to the input modules 209 to 212 to be transformed into digital values by the converter unit 208. The converted signals from the respective input modules are collected by the interface 213 to be sent via the cable 207 to the host computer 201.

Receiving the process signal, the computer 201 executes arithmetic operations such as a PID operation to thereby produce control operation values. These values are inputted via the cable 207 and the interface 213 again to the converter unit 208. The unit 208 converts a plurality of digital values into analog values to feed the values to the output modules 225 and 226 respectively corresponding to the first-loop and second-loop control output signals. The modules 225 and 226 amplify the received values to respectively generate final control output values and sends the values respectively to the control valves 222(1) and 222(2).

Figure 5:
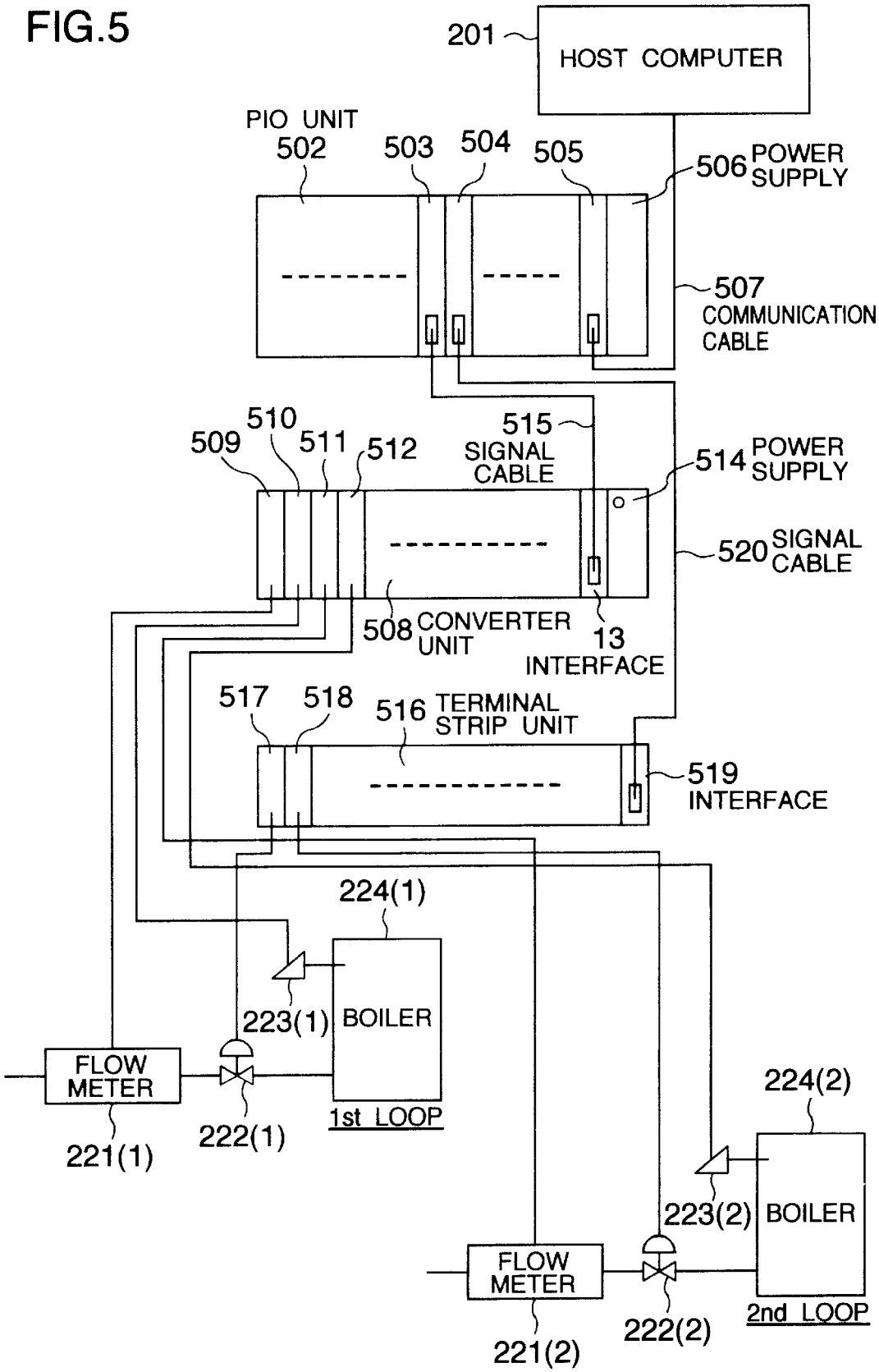
FIG. 5 is a diagram showing a system configuration example including a signal converter in accordance with the present invention.

As can be seen from the explanation of simple operations in accordance with the present invention, to appropriately process in the plant signals such as those from the flow meter and the control valve and signals of the host computer 201 shown in FIG. 5, three units of the signal converter including the PIO unit 502, the converter unit 508, and the terminal strip unit 516 are combined with each other to constitute one converter unit 208 as the signal converter.

Figure 1:
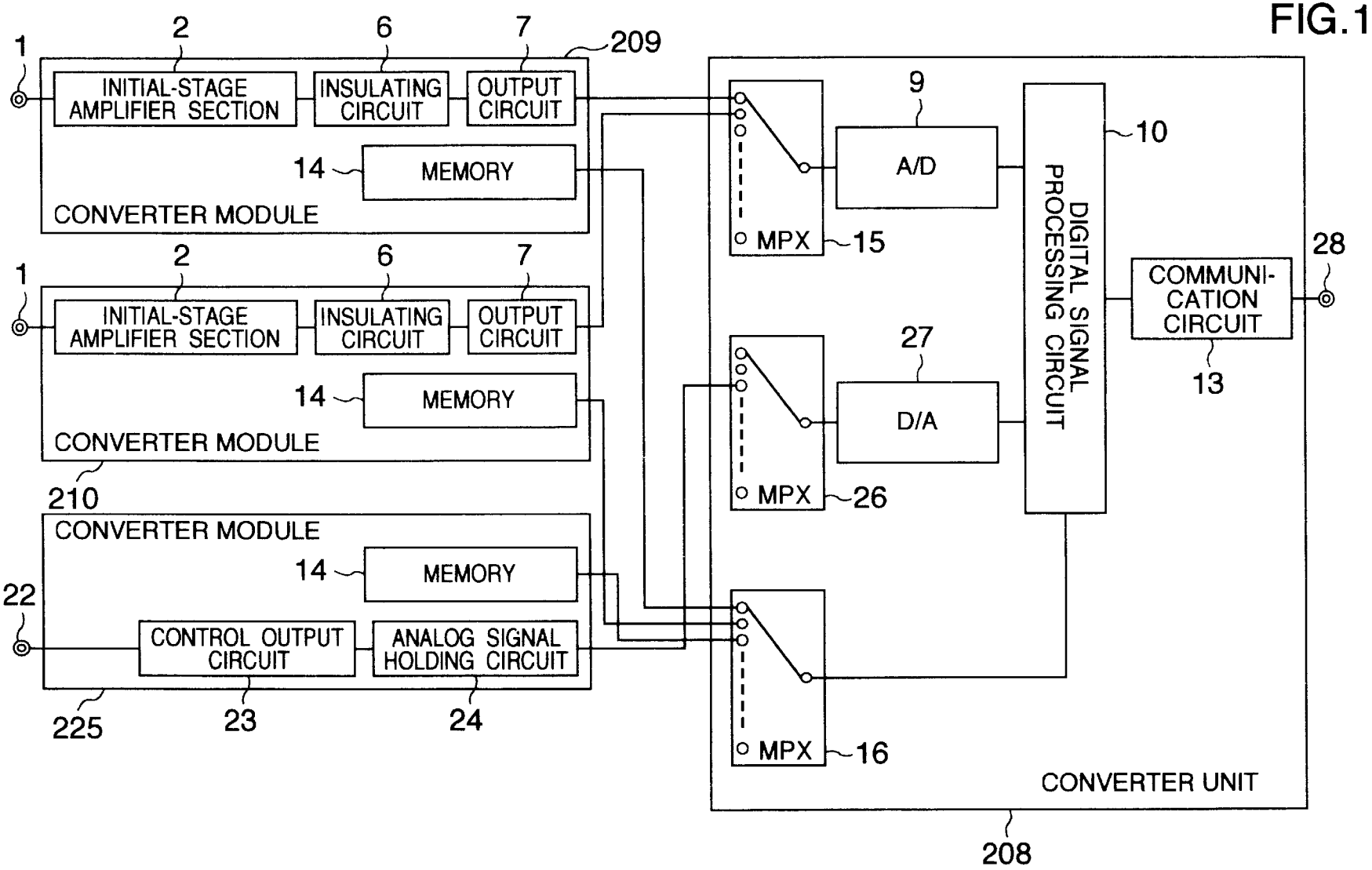
FIG. 1 is a block diagram showing an embodiment of the signal converter in accordance with the present invention.

Referring next to FIG. 1, description will be given of a converter unit functioning as the signal converter.

FIG. 1 shows in a block diagram a portion of the converter unit 208 of FIG. 2, in which only the two inputs and one output of the first-loop in FIG. 1 are shown as an example. This configuration includes an input terminal 1, an initial-stage amplifier section 2, an insulating circuit 6, an output circuit 7, an A/D converter 9, a digital signal processing circuit 10, a communication circuit 13, a non-volatile memory 14, multiplexers (MPXs) 15, 16, and 26, a control output terminal 22, a control output circuit 23, an analog signal holding circuit 24, a D/A converter 27, input modules 209 and 210, a signal processing section 208, an output module 225, and an output terminal 28.

The input modules 209 and 210 and the output module 225 of FIG. 1 are the same as those shown in FIG. 2, i.e, each of the elements are structured in a modular configuration. These associated components are assigned with the same reference numerals and are to be connected to the signal processing section 208. The section 208 includes a connector to be linked with a plurality of modules including the input module 209 and the output module 225. Each connector includes an input/output connection terminal and a connection terminal for the non-volatile memory 14 so as to be connected to an input module and/or an output module. Various numbers of connectors are arbitrarily used, for example, 8, 16, and 32 connectors. In FIG. 1, connectors 1 and 2 are respectively linked with input modules and connector 3 is coupled with an output module to handle input and output signals to and from the first loop of FIG. 2.

Referring now to the module 210 as an example, description will be given of operation of the input module for the sensor input processing.

The input module includes an interface which varies depending on a device including a thermocouple, a temperature resistance, a transmitter, or the like to be connected thereto. Namely, this module is dedicated to the type of the device connected to the input terminal. However, the module is fundamentally configured as shown in FIG. 1 to conduct an operation common to all input modules in which the input signal is amplified by the amplifier 2 to develop a predetermined voltage and the signals are insulated by the circuit 6 to be outputted from the circuit 7.

Figure 4:
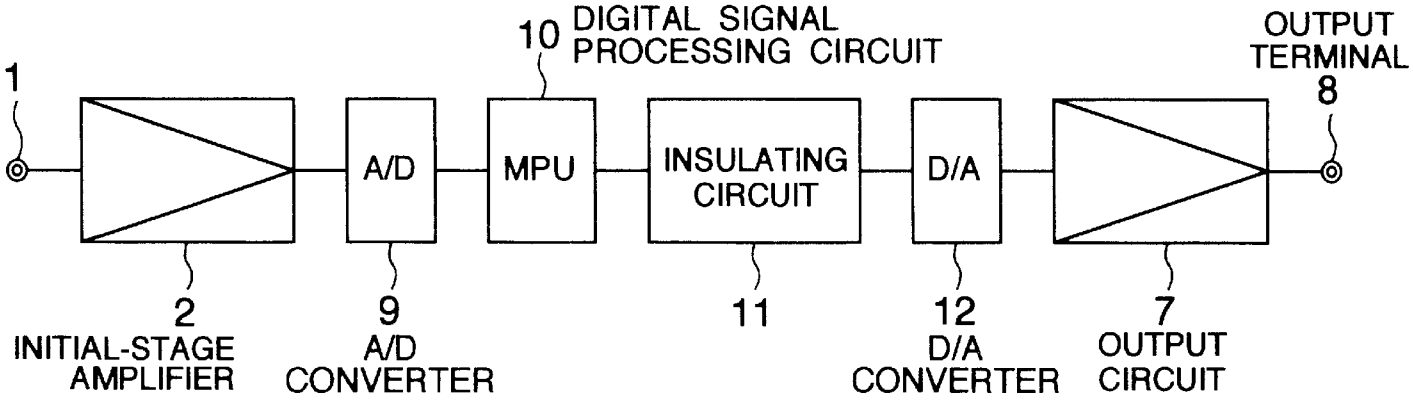
FIG. 4 is a diagram showing a second example of constitution of the conventional signal converter.

Assume that the temperature sensor 223 connected to the terminal 1 of the module 210 includes a K-type thermocouple with the operation range of from 300° C. to 600° C. The module 210 is accordingly set as follows in advance. The amplifier 2 has a gain to multiply the input signal by 89 and a bias voltage of 1.9 V like that shown in FIG. 4.

Figure 7:
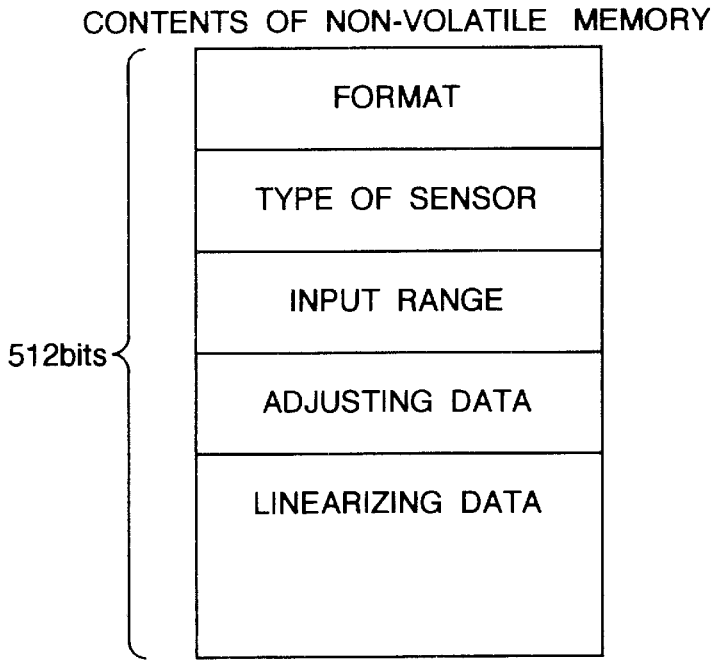
FIG. 7 is a diagram showing the memory layout of a non-volatile memory.

Each of the input and output modules includes a non-volatile memory 14. FIG. 7 shows the contents of the memory 14. As shown in this data layout, adjusting data for signals inputted and outputted to and from the respective modules, data items respectively of sensor types and measuring ranges and, data for the linearization are written in the memory 14.

Since the input module 210 is used for a thermocouple in this embodiment, the design values of gain and bias are respectively 89 and 1.9 V. However, even with the same design values of the modules, an error of several percent occurs due to fluctuation in quality of parts thereof. To correct the error, the prior technology is not used, for example, to arrange a variable resistor or the like. Namely, there are collected beforehand input and output data items to produce adjusting data therefrom such that the correction is achieved through arithmetic operations. Although the precision of linearization depends on the magnitude of linearizing data, a precision of about 0.1% can be guaranteed for the thermocouple when data is prepared at an interval of about 10° C. Since little data is required to be stored, the non-volatile memory 14 need only be a low-priced, serial-interface memory having a capacity of about 512 bits.

Figure 6:
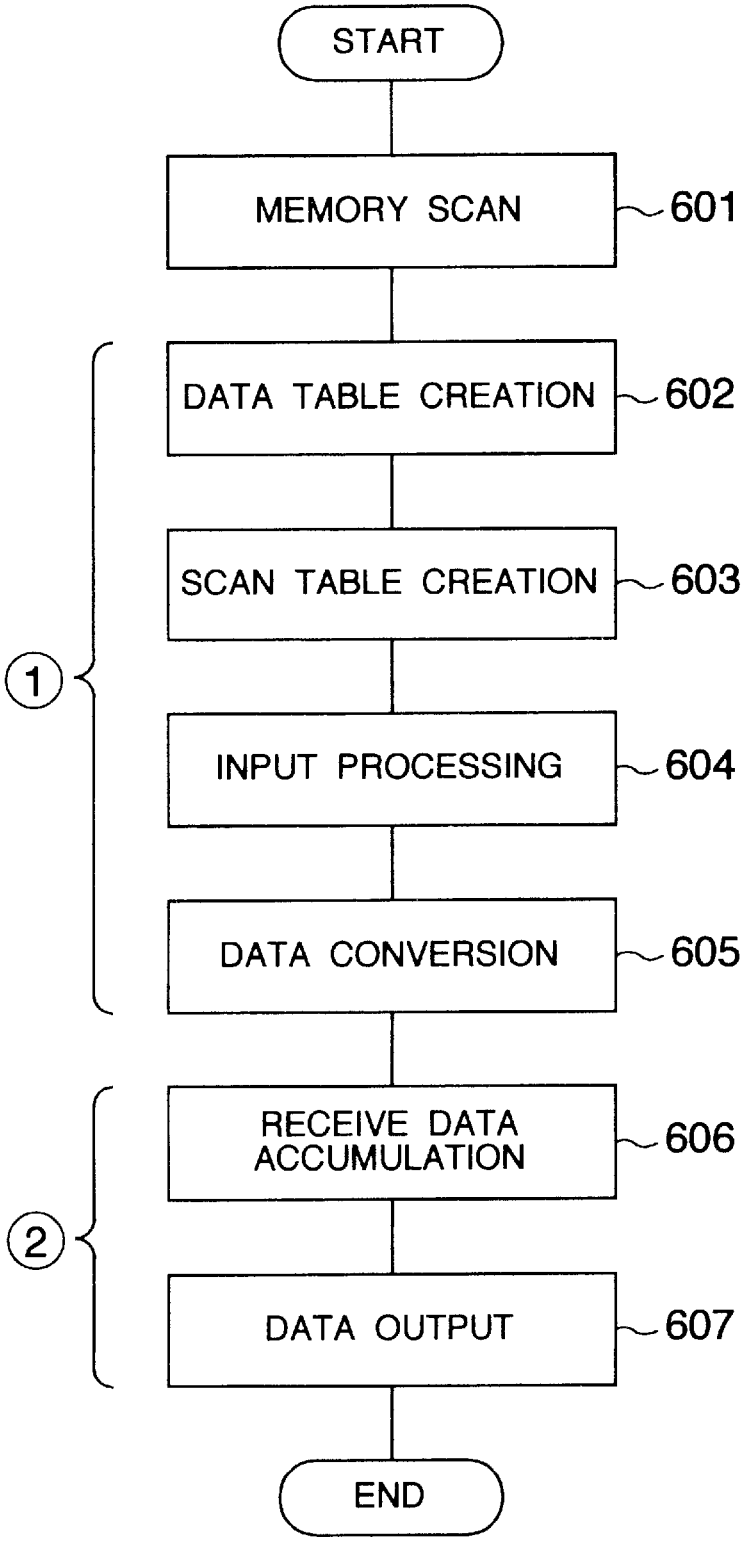
FIG. 6 is a flowchart showing processing of the signal converter in accordance with the present invention.

Referring now to the flowchart of FIG. 6, description will be given of operation of the processing section 208. The operation of FIG. 6 is assumed to be conducted when the system is powered and at a fixed interval of time thereafter. The repeated operation is carried out to also cope with a case in which the amplifier section is replaced in an active state.

First, sensor input processing ① will be described.

The multiplexer 16 first scans the memory 14 of each module connected to the processing section 208 to read information therefrom (step 601).

Figure 8:
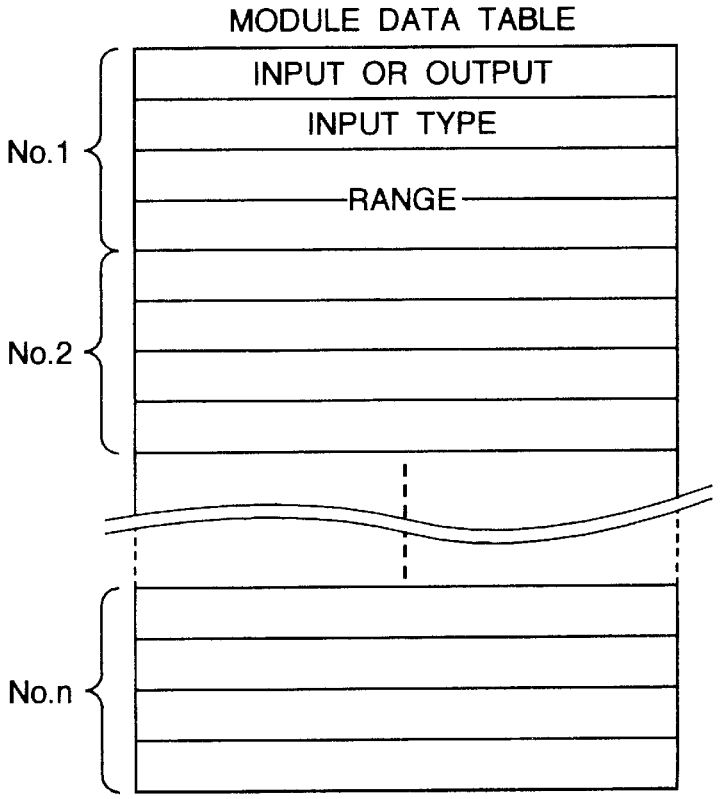
FIG. 8 is a diagram showing the data layout of a module data table.

Next, a module data table is generated with the data items obtained from the respective modules (step 602). FIG. 8 shows an example of the table. Stored in the table for each scanned module are an indication for the input or output operation of the module, types of input signals for an input module (i.e., a thermocouple, a thermoresistance, a transmitter, or the like), a measuring range of input signals, and data items for adjustment and linearization, if necessary.

Figure 9:
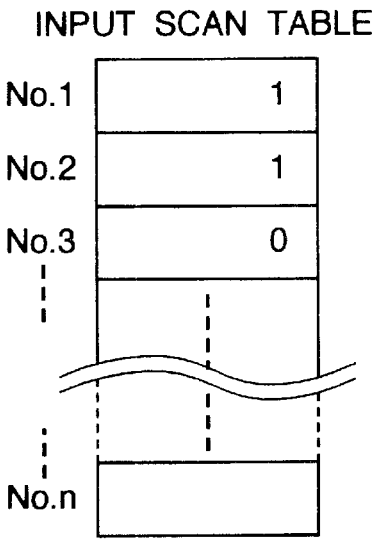
FIG. 9 is a diagram showing an input scan table.
Figure 10:
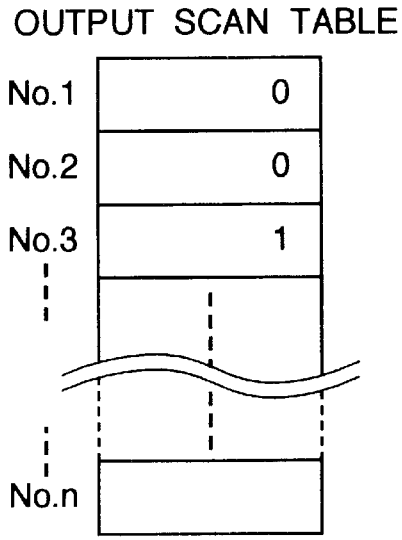
FIG. 10 is a diagram showing an output scan table.

In accordance with the data indicating the input or output operation of each module in the table, there are produced an input scan table and an output scan table as respectively shown in FIGS. 9 and 10 (step 603). In this case, "1" is set to each address of the input scan table in association with an input module and "1" is set to each address of the output scan table in association with an output module.

The multiplexer 15 then scans an input signal from each module connected to the processing section 208 (step 604). Even when output modules are connected to the section 208 or there exists a connector not connected to a module, the multiplexer 15 conducts the scanning operation.

In accordance with the input scan table, there are selected only the input signals from any module recognized as an input module such that the signals are converted by the digital signal processing circuit 10 to be outputted from the communication circuit 13 to the output terminal 8 (step 605). In the conversion, the data of the input signal received via the A/D converter 9 is adjusted according to the adjusting data of each module set beforehand to the module data table. Next, the range operation and the linearizing operation are conducted in accordance with the sensor type, the sensor measuring range, and the linearizing data to obtain output values. In contrast with the conventional example of FIG. 4 in which the values are converted into analog values as output data, the output data is transmitted from the communication circuit 13 in this embodiment for the following reasons. Even analog signals are received as data, the host computer converts the analog signals into digital signals for processing thereof. It is naturally possible to dispose a D/A converter circuit and an output circuit in a stage following the digital signal processing section 10 to output analog signals therefrom.

Next, control output processing ② will be described.

Figure 11:
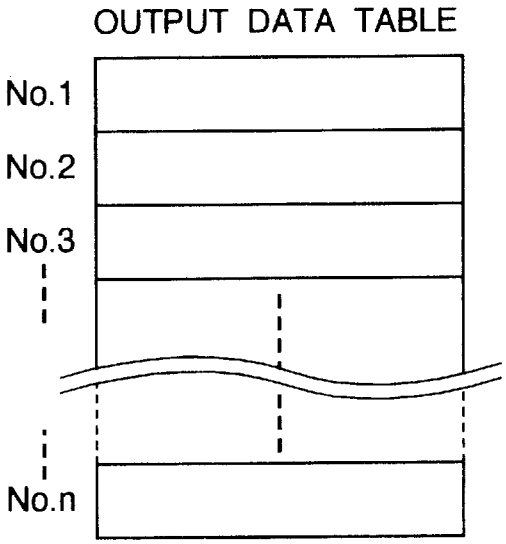
FIG. 11 is a diagram showing an output data table.

The control output data is to be communicated from the host computer. The processing section 208 stores, on receiving control output data to be sent to an output module connected to a connector thereof, the data in an output data table of FIG. 11 (step 606).

Subsequently, the unit 208 scans the contents of the table to send control output data to a subsequent module. In the unit 208 of the embodiment, although each of connectors 1 and 2 is connected to an input module and connector 3 is connected to an output module, the data output operation is carried out for all channels. Since the wire connection varies in hardware between the input and output modules, data outputted to an input module is only ignored and hence there does not occur any trouble.

In an operation to send data to the output module 225, when the module 225 is selected by the multiplexer 26, control operation data allocated to the module 225 is converted by the D/A converter 27 into an analog signal to be outputted therefrom. The data is thereby held by the analog signal holding circuit 24. Next, the data is fed by the output circuit 23 to the control output terminal 22. The holding circuit 24 need only be a simple circuit including a capacitor. The circuit 23 is a voltage-to-current (V/I) converter to transform an analog voltage signal into a current signal ranging from 4 dc mA to 20 dc mA.

Output processing ② is accomplished as above. It is to be appreciated that even when a plurality of input and output modules are disposed in the configuration, the operations above can be conducted by combining input processing ① with output processing ②.

After output processing ②, control is returned to step 601 of FIG. 6 at a fixed interval of time to repeatedly execute the processing.

In the input processing of step 604 and the data output processing of step 607, the processing speed can be increased by selectively carrying out the processing only for modules for which "1" is set in the input and output scan table.

Thanks to the processing above, the PIO unit, the converter unit, and the terminal strip unit can be implemented in one unit.

When compared with the conventional configuration of FIG. 5, the PIO unit and the terminal strip unit are unnecessary in the structure of the present invention shown in FIG. 2. Namely, the system can be constructed at a lower price. Wirings between these units are also unnecessary. The input and output modules can be combined with each other for each control loop in the configuration, which facilitates maintenance thereof.

In accordance with the present invention, the input/output module (amplifier section) can be simply configured with an amplifier circuit, an insulating circuit, and a non-volatile memory. This reduces the cost of the module per point. Since the input and output modules can be mounted in a flexible and varied manner, the input and output signals can be collectively handled for each control loop and hence maintenance thereof is facilitated.

When the system is configured in accordance with the present invention, the PIO and terminal strip units which are necessary in the prior art can be dispensed with. Therefore, the system cost is considerably reduced.

The signal processing section supports a plurality of modules. When n modules are assumed to be connected to the section, the cost per module is reduced to 1/n of the original cost. There is fundamentally configured a multi-range signal converter in accordance with the present invention and an input/output module (amplifier section) of one type can be applied to various ranges, which also advantageously minimizes the system operation cost.

The non-volatile memory of the module includes adjusting data so that the variable resistor of the prior art is unnecessary and the adjusting operation conducted by rotating the control of the variable resistor is dispensed with, which also lowers the system cost. The movable section becomes unnecessary and hence reliability of the system is increased. Data items of the sensor type and measuring range are stored in the non-volatile memory of the module. Consequently, when a failure occurs in a module, only the module is required to be replaced, i.e., the recovery operation can be achieved at a high speed. Since various modules can be connected to the signal processing unit, it is possible to construct signal converters for various purposes.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

We claim:

1. An input and output signal converter system of a mixed type which receives signals representing physical quantities from a plurality of sensor terminal ends for detecting physical quantities in a plant, and conducts a necessary correction for the signals to send the signals to a host computer, and which transmits signals from the host computer to operation terminal ends in the plant, wherein, the signal converter system comprises a sensor terminal end amplifier section including a processing unit for receiving a signal from the sensor terminal end, conducting a predetermined amplifying operation for the signal and outputting the signal to a connecting unit, and a storage unit in which information items related to the sensor terminal end and the processing unit are stored;

an operation terminal end amplifier section including a converting unit for converting signals from the connecting unit into predetermined control signals which can be received by the operation terminal end and a storage unit in which information items related to the operation terminal end and the converting unit are stored; and a signal converting section including the connecting unit adapted to be connected to the sensor terminal end amplifier section and the operation terminal end amplifier section, and a signal processing unit connected to the connecting unit for conducting signal processing to communicate with the host computer.

2. A signal converter system in accordance with claim 1, wherein the sensor and operation terminal end amplifier sections can be installed in and can be removed from an arbitrary position of the connecting unit of the signal converter.

3. A signal converter system in accordance with claim 2, wherein the connecting unit includes a first terminal to receive a signal from the processing unit of the sensor amplifier section, a second terminal to send a signal to the converting unit of the operation amplifier section, and a third terminal to read information from the storage unit respectively of the sensor and operation amplifier sections.

4. A signal converter system in accordance with claim 1, wherein the processing unit of the sensor amplifier section is set differently in accordance with a type of the sensor terminal end connected thereto.

* * * * *

UNITED STATES PATENT AND TRADEMARK OFFICE

CERTIFICATE OF CORRECTION

PATENT NO. :6,052,655
DATED :April 18, 2000
INVENTOR(S) :Teruo Kobayashi, et al.

It is certified that error appears in the above-indentified patent and that said Letters Patent is hereby corrected as shown below:

| Column | Line | |
|---|---|---|
| 3 | 35 | After "range, an" insert --input zero point and an input span point are set for --. |

Signed and Sealed this

Twenty-seventh Day of March, 2001

Nicholas P. Godici

*Attest:*

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,052,655
DATED : April 18, 2000
INVENTOR(S) : Teruo Kobayashi et al.

It is certified that error appears in the above-identified patent and that said Letters Patent is hereby corrected as shown below:

Title page,
Change "[73] Assignee: Hitachi, Ltd., Tokyo, Japan" to
-- [73] Assignees: Hitachi, Ltd., Tokyo; Hitachi Naka Electronics Co., Ltd., Hitachi Instrument Engineering Co, Ltd., both of Ibaraki-ken, all of Japan. --

Signed and Sealed this

Sixteenth Day of October, 2001

*Attest:*

Nicholas P. Godici

NICHOLAS P. GODICI
*Acting Director of the United States Patent and Trademark Office*

*Attesting Officer*